United States Patent [19]

Tanaka et al.

[11] 3,950,595

[45] Apr. 13, 1976

[54] TRANSFERRING PAPER FOR ELECTROPHOTOGRAPHY

[75] Inventors: Hiroshi Tanaka; Ikuo Soma, both of Tokyo, Japan

[73] Assignee: Canon Kabushiki Kaisha, Tokyo, Japan

[22] Filed: Nov. 26, 1973

[21] Appl. No.: 419,046

[52] U.S. Cl. ..... 428/511; 96/1 LY; 428/199; 428/211; 162/168 R

[51] Int. Cl.[2] ..... D21H 1/28; D21H 1/30

[58] Field of Search ..... 96/1 R, 1 LY; 117/155 UA, 117/161 UC, 161 UN; 428/199, 211, 511; 162/168

[56] References Cited

UNITED STATES PATENTS

| | | | |
|---|---|---|---|
| 3,457,209 | 7/1969 | Mikofalvy | 117/155 X |
| 3,653,894 | 4/1972 | Levy et al. | 96/1.7 |
| 3,674,896 | 7/1972 | Purcell et al. | 117/155 X |
| 3,682,632 | 8/1972 | Arai et al. | 117/155 X |
| 3,702,785 | 11/1972 | Knechtges et al. | 117/155 UA |
| 3,778,263 | 12/1973 | Arai et al. | 117/155 X |

*Primary Examiner*—Michael R. Lusignan
*Attorney, Agent, or Firm*—Fitzpatrick, Cella, Harper, Scinto

[57] ABSTRACT

The present invention provides transferring papers for electrophotography which contain specific polymeric compounds and which are particularly useful in transferring by electrophoresis. The specific polymeric compounds are copolymers prepared from one or more monomers represented by the formula:

wherein A is hydrogen or $CH_3$; and B is alkyl, and at least one monomer selected from the group of unsaturated carboxylic acids and acrylonitrile.

12 Claims, 2 Drawing Figures

TRANSFERRING PAPER FOR ELECTROPHOTOGRAPHY

BACKGROUND OF THE INVENTION

1. Field of the Invention

The present invention relates to transferring papers for use in electrophotography wherein electrostatic latent images are developed by a liquid developer and the images thus formed are transferred to a transferring paper to obtain copied images. More particularly, the present invention relates to transferring papers, in particular, useful in electrophotography wherein images developed by a liquid developer are transferred in the presence of a liquid carrier by electrophoresis.

2. Description of the Prior Art

A number of electrophotographic processes such as Carlson process, Photovoltaic process, Smoke printing process, Persistent internal polarization process, Electrolytic electrophotography, Canon NP process, electrophoretic electrophotography, and the like are well known in the art and it is also known to one skilled in the art that the images formed by the above processes are transferred or that the electrostatic latent image formed are made visible by a liquid developer and then transferred to a transferring paper to obtain permanent printed copies.

Generally, in a wet-development, the latent image is made visible using a liquid developer which is prepared by dispersing toners in an insulating liquid and the image thus developed is then transferred in an extremely short period of time by electrophoresis by bringing a carrier liquid film on a photosensitive plate in contact with a transferring paper. In case that a visible image is formed in a liquid film as in Electrophoretic electrophotography, the image is transferred by electrophoresis during the short period of time while the liquid film is in contact with the transferring paper.

However, if usual papers are used as the transferring paper, the paper absorbs the carrier liquid during the short contact period of time and thus the carrier liquid film cannot be maintained. Therefore, the electrophoresis of toner is prevented and the transferring efficiency is considerably lowered and, as a result, the transferred image is disturbed.

Where a large amount of the carrier liquid remains on the photosensitive plate, the transferability of toner image is increased but, however, the transferring paper is unnecessarily wetted, whereby a long time is undesirably needed at the drying stage. In addition, a large amount of carrier vapor is formed, which is not desired from a hygienic point of view.

Furthermore, if the paper absorbs a large amount of carrier liquid, wettability of the photosensitive plate or the electrode is lowered and therefore cleaning thereof becomes difficult, and sometimes they are damaged.

Accordingly, it is necessary to lower oil absorbant properties of the transferring paper and to improve hold out thereof so as to depress the absorption of the carrier liquid and so as to maintain the carrier liquid film during the contact period of time while the transferring paper is in contact with the photosensitive plate or electrode.

A typical method of imparting oil resistance to paper and depressing oil absorptivity thereof is to form an oil repellent, i.e. high hydrophilic polymer film on the surface of paper or to impregnate the paper with such a polymer. Polyvinyl alcohol, cellulose derivatives, salts of hydrophilic group containing polymers, water soluble natural polymers, and the like are used for coating, impregnation, and compounding. Although oil resistance of paper is improved and oil absorptivity thereof is decreased by using the foregoing polymers, the paper so prepared is insufficiently dried at the paper machine or coating machine due to high film forming properties of such polymers. Furthermore, the paper formed has defects in that the paper tends to curl and the oil resistant film is readily cracked during calendar processing. The paper is sensitive to moisture due to high hydrophilic properties thereof. Since the binding strength of the paper with a developer is poor, the formed image is undesirably removed.

SUMMARY OF THE INVENTION

An object of the present invention is to provide transferring papers which remove the drawbacks as mentioned above and which are of high transferring efficiency and are able to provide fogless and clear, transferred images.

Another object of the present invention provides transferring papers which possess excellent properties in fixability of transferred toner image.

A further object of the present invention is to provide transferring papers which do not lose plain appearance and are free from curl.

Further object of the present invention is to provide transferring papers desirable from a hygienic standpoint which do not disadvantageously absorb a carrier liquid and thus which prevent the production of a large amount of carrier vapor at dry-fixing stage.

DESCRIPTION OF THE PREFERRED EMBODIMENTS

Figure 1:
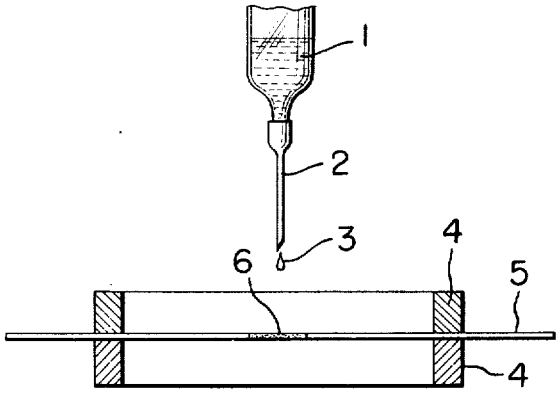
FIG. 1 shows an apparatus for measuring resistance to oil of the paper formed in accordance with the present invention.

The present invention is directed to transferring papers for electrophotography which contain copolymers prepared from one or more monomers represented by the formula (I):

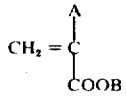

(I)

wherein A is hydrogen or $CH_3$; and B is alkyl, and at least one monomer selected from the group of unsaturated carboxylic acids and acrylonitrile.

In the present invention, the above copolymers may be used by being neutralized or partially neutralized.

Furthermore, the above copolymers e.g., water soluble acrylic resins may be used in combination with various kinds of synthetic resin emulsions.

Acrylic esters or methacrylic esters exhibit various kinds of characteristics depending upon the kind of alcohol to be used and the ratio of alcohol to acrylic acid or methacrylic acid. Furthermore, by partially incorporating carboxylic acid group, partially or completely neutralized carboxylic acid group, or nitrile group into copolymers or changing the ratios thereof, the properties of the copolymer as a treating liquid or coating liquid for paper, such as viscosity, drying properties, ability to retain water, ability to adhere, and the like can be easily changed. Furthermore, hardness, adhesiveness, curling properties, sensitivity to moisture, resistance to oil, ability to fix developer, and the like of the formed paper or the surface thereof can be properly changed. They might be achieved by using other synthetic resins, but it has been found that the properties required for the transferring paper of the present invention can be most satisfactorily attained by using acrylic resins prepared from the monomers as mentioned above.

Alkyl group of acrylic ester or methacrylic ester for use in preparing the acrylic resins of the present invention is preferably of low molecular weight (carbon atom's number of less than 10) and straight such as methyl, ethyl, butyl, hexyl, octyl, 2-ethylhexyl, and the like. The mixing ratio of the esters including that of acrylic ester to methacrylic ester should be determined according to the properties of alcohols constituting each of the esters and it is preferred that esters of soft and hard types are used taking into account strength, hardness, adhesiveness, curling properties, developer fixability, and the like of the formed resin film or film forming ability, viscosity, or the like of the acrylic resin.

Particularly, in transferring paper, film forming ability, film forming temperature, and glass transition temperature of a synthetic resin are correlated with blocking, double feeding, and jam, and thus it is not preferred that glass transition temperature of the resin is below 20°;l C. However, if the glass transition temperature is high, there undesirably occur curl of paper, cracking of coating surface during calendar processing, and like disadvantages, and thus it should be made below 50°C.

The carboxylic acid content of the acrylic resin is important because it determines the balance of hydrophilic properties and oleophilic properties of the present resin. That is, if the carboxylic acid content is too small, hydrophilic properties of the resin is poor and it lacks resistance to oil and furthermore in case of producing water soluble resin, it cannot be made water-soluble. On the other hand, if the carboxylic acid content goes beyond 35 mole %, the resistance to oil is improved, but the resin becomes brittle, hard, highly hygroscopic, and highly adhesive, and thus the capability to fix toner is deteriorated. As a result, the paper prepared using such a resin is not satisfactory as the transferring paper. Accordingly, the range of 5 to 35 mole % of carboxylic acid content is preferred in any case of water-soluble resin, micro sol or emulsion. The above discussion is based on the data of Table 1.

Table 1

Effect of Carboxylic Acid Content

| Sample No. | 1 | 2 | 3 | 4 | 5 | Ordinary paper |
|---|---|---|---|---|---|---|
| Acrylic resin composition (mole %) | | | | | | |
| ethyl acrylate | 50 | 75 | 60 | 45 | — | — |
| butyl acrylate | — | 5 | — | — | — | — |
| methyl methacrylate | 20 | — | 20 | 15 | — | — |
| acrylic acid | 30 | — | 20 | 40 | 100 | — |
| methacrylic acid | — | 20 | — | — | — | — |
| neutralizing agent | — | ammonia | sodium hydroxide | sodium hydroxide | sodium hydroxide | — |
| form | emulsion | emulsion | aqueous solution | aqueous solution | aqueous solution | — |
| Properties of transferring paper | | | | | | |
| resistance to oil (sec) | 3.0 | 4.0 | 4.0 | 3.0 | 2.0 | 0.0 |
| air permeability (sec) | 300 | 380 | 400 | 310 | 220 | 50 |
| optical density of image | 1.2 | 1.1 | 1.1 | 0.9 | 0.9 | 0.5 |
| fixability of developer (%) | 95 | 80 | 75 | 60 | 55 | 95 |
| curling properties (mm) | 5 | 6 | 4 | 13 | 15 | 0 |

Note:

1. 4g/m² (as solid) of a sizing press coating liquid comprising 30 parts of the above acrylic resin, 30 parts of polyvinyl alcohol, and 30 parts of clay (all as solid) is coated on the both sides of a high quality paper of 60g/m² with a desk sizing press.

2. "Ordinary paper" means a high quality paper for offset printing of 64g/m².

3. "Air permeability" means Galley air permeability.

4. "Optical density of image" means optical density of solid black portion of image on a transferring paper (measured with a reflecting densitometer).

5. "Curling properties" means the height (mm) of edge curl of a 100 mm $\phi$ circular paper which is allowed to stand at 20°C and 65% RH for 24 hours.

6. "Fixability" of transferred image is measured as follows. A transferring paper to which image is transferred and dried, is placed on a horizontal surface plate in such a manner that image surface is faced out. On the image surface were piled soft papers of 8cm square having coarse surface, and further an aluminum block was placed thereon. The load is about 12g/cm². The papers having coarse surface and aluminum block thereon were fixed so as to prevent horizontal movement thereof and then the transferring paper is drawn at a rate of about 7m/sec, which is repeated five times. The resulting image density is measured and the ratio of the resulting image density to the initial image density is indicated by percent (%).

Figure 2:
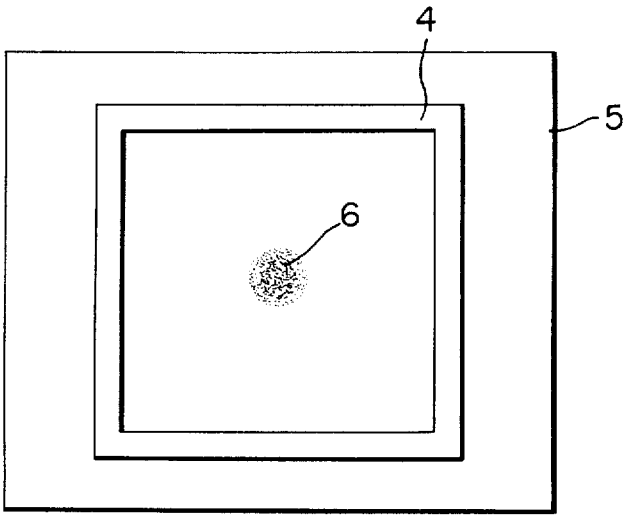
FIG. 2 is a top plan view illustrating the paper of FIG. 1 permeated by a drop.

7. "Resistance to oil" is measured with an apparatus as shown in FIG. 1. The reference numeral (1) is an injector, (2) is a needle (H5 defined by JIS-T3101), (3) is a carrier liquid (Isopar G supplied by Esso), (4) is a spacer, and (5) is a paper whose resistance to oil is to be measured. A drop of a carrier liquid (about 0.004 ml) is dropped on a paper (5). The dropped surface (6) is observed as illustrated in FIG. 2. The permeation of Isopar G into paper makes the paper transmittable. The drop permeates a part of the paper (pin hole) and then permeates all the whole of the dropped surface (about 10 to 15 mm $\phi$). A period of time which elapses from just the time when Isopar G arrives to the paper (5) to the time when permeation of the whole drop surface (6) is complete, is measured with a stop watch in units of 0.1 second. Such a measurement is carried out ten times at different places on the same paper and the average value of the ten trials is determined as "resistance to oil." It is preferred for transferring paper that "resistance to oil" is within the range of 1.0 to 10.0 seconds.

As unsaturated carboxylic acids as herein used, acrylic acid, methacrylic acid, itaconic acid, maleic anhydride, and the like are preferably used.

By introducing acrylonitrile into the acrylic resin of the present invention, image properties of transferring paper have been improved and thus there can be obtained a uniform image which is free from white spot. However, as can be seen from Table 2, introduction of a large amount of acrylonitrile does not bring about any additional good results and rather there is a fear of deteriorating heat-resistance of the acrylic resin. Effect of the introduction of acrylonitrile is considered to be obtained in an amount of below 10 mole %.

Table 2

| Effect of Acrylonitrile | | | | |
|---|---|---|---|---|
| Sample No. | 1 | 2 | 3 | 4 |
| Acrylic resin composition (mole %) | | | | |
| ethyl acrylate | 55 | 55 | 53 | 50 |
| methyl methacrylate | 30 | 30 | 27 | 25 |
| acrylic acid | 15 | 12 | 13 | 15 |
| acrylonitrile | 0 | 3 | 7 | 10 |
| neutralizing agent | sodium hydroxide | " | " | " |
| form | aqueous solution | " | " | " |
| Properties of transferring paper | | | | |
| optical density of image | 1.1 | 1.1 | 1.2 | 1.2 |
| fixability of developer (%) | 75 | 80 | 75 | 75 |
| uniformity of solid black portion of image | 6.0 | 8.5 | 9.0 | 9.5 |

Note:

1. Transferring paper is prepared in the same manner as in Table 1.

2. "Uniformity of solid black portion of image" means a fixability of developer at the solid black portion of image on transferring paper (full mark is 10).

3. Smoothness of transferring paper is 120 seconds as indicated by Bekk.

The neutralizing agents as herein used include caustic soda, ammonia, organic amines, and the like. When using ammonia or organic amines, cross linking is achieved by simultaneously utilizing a third component since the end group of ammonia or organic amines become reactive. Thus sensitivity to moisture and adhesiveness can be improved. It is to be noted that the neutralizing agent should be selected taking into account pot-life of the treating liquid and effect of cross linking. In the case of aqueous solution, degree of neutralization varies depending on the amount of carboxylic acid and however it is preferred that the degree of neutralization is greater. In the case of micro sol and emulsion, neutralization is not necessarily required.

In preparing the transferring paper of the present invention, the acrylic resin may be used solely or in combination with water-soluble high molecular compounds as an adhesive. The water-soluble high molecular compound may be any known one which is of high resistance to oil and which is capable of forming a film. Of the known water-soluble high molecular compounds, those which are well miscible with the acrylic resin of the present invention and which function as a protective colloid for the emulsion, should be selected. That is, polyvinyl alcohol, carboxylic cellulose, methyl cellulose, ethyl cellulose, starch, starch derivatives, casein, styrene-maleic anhydride copolymer salts, vinyl acetate-maleic anhydride copolymer salts, and the like are used. When using the acrylic resin of the present invention together with the foregoing resins, the disadvantages of the foregoing resin are avoided and thus there can be obtained high quality transferring paper.

As the other synthetic resin emulsions as herein used in combination with the water-soluble acrylic resin of the present invention, there may be used any emulsion which is used as the cellulose based adhesive. That is, vinyl acetate-, styrene/butadiene-, acrylonitrile-, acrylonitrile/butadiene-, ethylene/vinyl acetate-, vinylidene chloride based emulsion may be employed.

As stated above, the water soluble acrylic resins are preferably prepared by using 5 to 35 mole % of carboxylic acid as a hydrophilic group in addition to acrylate and/or methacrylate and the like or further by using acrylonitrile of less than 10 mole %. It is preferred that neutralization of the acrylic resin to make it water-soluble is carried out by using inorganic alkalis or organic amines.

Introduction of the water-soluble resin into emulsions improves considerably stability of the emulsions. As the protective colloid for emulsion, there are known those suitable individually for the emulsions. For instance, polyvinyl alcohol is considered suitable for vinyl acetate based emulsion, polysodium acrylate for acrylonitrile based emulsion, casein for styrene/butadiene based emulsion, and so on. However, it has been very difficult to satisfactorily provide the requirements for transferring paper while maintaining the properties of protective colloid. This problem has been solved by using the water-soluble acrylic resin of the present invention. The effect of the acrylic resin on the stability of emulsion is shown in Table 3 and the effect of the mixing ratio of the acrylic resin to emulsions is shown in Table 4.

Table 3

| Improvement in Heat-and Mechanical Stability of Emulsions by adding Water-soluble Acrylic Resin | | | | |
|---|---|---|---|---|
| Emulsions | Acrylic Emulsion | Styrene-Butadiene Emulsion | Vinyl Acetate Emulsion | Polyvinyl alcohol Emulsion |
| Emulsion alone | | | | |
| amount of coarse particle | 8 | 12 | 11 | 11 |
| stability index | 1.15 | 1.42 | 1.33 | 1.33 |
| PH | 7.1 | 8.0 | 6.4 | 6.4 |
| Water-soluble acrylic resin added emulsion | | | | Polyvinyl alcohol |

Table 3-continued

| Improvement in Heat-and Mechanical Stability of Emulsions by adding Water-soluble Acrylic Resin | | | | |
|---|---|---|---|---|
| Emulsions | Acrylic Emulsion | Styrene-Butadiene Emulsion | Vinyl Acetate Emulsion | Polyvinyl alcohol Emulsion |
| amount of coarse particle | 1 | 2 | 2 | 1 |
| stability index | 1.00 | 1.02 | 1.05 | 1.02 |
| PH | 7.9 | 8.0 | 7.0 | 7.0 |

Note:

Stability measuring conditions: A solution having a 10% solid content is heated to 60°C and stirred for 15 minutes with a homomixer at 6000 r.p.m.

1. "Amount of coarse particle" means the amount which remains after passing through a 150 mesh sieve (mg/g).

2. "Stability index" means the ratio of the concentration in a lower portion to that in a higher portion of emulsions after allowing them to stand for 36 hours.

3. As the water-soluble acrylic resin, the same as in Example 6 is used.

4. The mixing ratio of the water-soluble acrylic resin is 50% by weight.

5. Acrylic emulsion, styrene/butadiene emulsion, and vinyl acetate emulsion are the same as used in Examples 6, 8 and 7, respectively.

Table 4

| Effect of Mixing Ratio of Water-Soluble Acrylic Resin | | |
|---|---|---|
| Mixing ratio of Water-soluble acrylic resin | Amount of coarse particle (mg/g) | Stability index |
| 0 | 12 | 1.17 |
| 10 | 2 | 1.02 |
| 20 | 2 | 1.01 |
| 30 | 2 | 1.00 |
| 50 | 1 | 1.00 |
| 100 | 1 | 1.00 |

Note:

1. Stability measuring conditions are the same as in Table 3.

2. Emulsion used is acrylic resin emulsion.

As can be understood from the foregoing description, in accordance with the present invention the water-soluble acrylic resin makes up for the disadvantages of emulsions and enables them to fully exhibit the advantages thereof while at the same time the disadvantages of the water-soluble acrylic resin itself are made up for and the advantages thereof are fully exhibited.

That is, the water soluble acrylic resins are of high resistance to oil, and the solution properties or coating properties thereof are very similar to those of conventional natural, synthetic, and semi-synthetic polymeric compounds. The water soluble acrylic resin, however, possesses oleophilic properties that conventional compounds do not possess and furthermore, such oleophilic properties can be controlled. Thus, the disadvantages of conventional natural, synthetic, and semi-synthetic high polymeric compounds, with respect to sensitivity to moisture, hardness of film, curl properties, cracking of film, and the like can be improved.

Accordingly, the transferring paper of the present invention may be improved greatly as compared with conventional one by using the acrylic resin in the form of emulsion or the water soluble acrylic resin solely or in combination with conventional natural, synthetic, and semi-synthetic polymeric compounds. However, when a mixture of the emulsions and conventional natural, synthetic, or semi-synthetic resins is used, the problem is encountered in stability of the emulsions even though adhesives which serve as a protective colloid for the emulsions are simultaneously utilized and furthermore, the disadvantages of conventional adhesives can not be sufficiently removed. Where the water soluble acrylic resin is used together with conventional adhesives, the disadvantages of conventional adhesives can be improved and yet the improvement of coating properties is not sufficient since both of them are water soluble.

On the other hand, where the water soluble acrylic resin is used together with the emulsions, the disadvantages are all avoided and the features of each of them are fully derived. That is, the problem of the stability of the emulsion can be fully eliminated, and capability to retain water and lubricity of coating solution are improved and thus they are satisfactorily used with a high speed sizing press or coater. The disadvantages of conventional techniques; curl properties, dependency on temperature, and fixability of developer are improved.

The treating liquid or coating liquid of the present invention may include pigments. The addition of such pigments is effective for improvement in smoothness of transferring paper, easy writing, uniformity of image, dryability of paper after transferring, and for prevention of adhesiveness and blocking, which, to the contrary, results in deterioration of resistance to oil. Thus, pigment should be used appropriately. Dispersion agents, lubricant agents, and antifoaming agents are naturally used along with the use of pigment and other adhesives and, however, the advantages of the present invention are not adversely affected by the use of such agents.

As the transferring paper of the present invention are excellent in resistance to oil, and affinity with developer, it may be used as a substrate for use in coating organic solvents. That is, the paper is excellent in capability to retain organic solvent based paints for coating and it has an appropriate affinity and thus there can be obtained processed paper which forms highly uniform coats.

The present invention is explained in detail with the following examples and it should be noticed that they do not limit the scope of the present invention.

EXAMPLE 1

100 parts of fine crystal CdS and 20 parts of a 30% solution of vinyl chloride-vinyl acetate copolymer in toluene were mixed, and toluene was added to the mixture to adjust the viscosity thereof to those suitable in coating. The dispersion solution so prepared was coated on an aluminum substrate to form a 40 $\mu$ thick film, when dried, and dried. Polyethylene terephthalate film (thickness of 30 $\mu$) was adhered on the photoconductive layer as obtained above by an expoxy resin based adhesive to prepare a three layer photosensitive member.

Electrostatic latent image was formed on the photosensitive member in accordance with the electrophotographic process as disclosed in Japanese Patent Publication No. 23910/1967.

The following were fully admixed for about 2 hours with a homomixer:

| | |
|---|---|
| Carbon black | 6g |
| Cyclized rubber (20% xylene solution) | 40g |
| Low molecular polyethylene having an average molecular weight of 1000 (20% xylene solution) | 5g |
| Cumarone resin (20% xylene solution) | 30g |
| Isopar G (Trade name) petroleum solvent | 120 g |

20 ml of the resulting dispersion solution was added to 2 *l* of Isopar G containing 40 ml of lecithin while stirring to prepare a liquid developer. The above electrostatic latent image was developed with the liquid developer to obtain a sharp printed image on the photosensitive member.

To a starting material consisting of 20 parts of needle leaved tree bleached kraft pulp (N.BKP) smashed to freeness of 300 ml and 80 parts of broad-leaved tree bleached kraft pulp (L.BKP) were added 0.3 parts of rosin size, 1.5 parts of alum, and 8 parts of talc, which was then applied to Fourdrinier machine to produce a paper whose substance was 60g/m². A sizing press solution having the following composition was coated on the paper as prepared above in an amount of 3g/m² as solid with a sizing press whereby there was obtained a transferring paper having air permeability of 5500 seconds, curl of 7 mm, and hold out of 10 seconds.

| | |
|---|---|
| Emulsion of copolymer comprising 50 mole% of ethylacrylate, 20 mole % of methyl methacrylate, and 30 mole% of acrylic acid | 70 parts |
| Methyl cellulose (Trade name:Metholose 658H, supplied by Shinetsu Kagaku) | 0.5 parts |
| Clay for coating | 30 parts |
| Melamine resin (Trade name:Sumirez 613, supplied by Shumitomo Kagaku) | 0.5 parts |
| Antifoaming agent (silicone) | 0.1 part |
| Dispersing agent (Trade name:Primal 850, supplied by Nippon Akuriru Kagaku) | 0.02 parts |
| Water | 100 parts |

The above developed image was transferred onto the transferring paper by Corona transferring process and air-dried, whereby there was obtained a clear printed image whose fixability was excellent. Density of image was 1.2, fixability was 95%, and uniformity of image was 9.0.

EXAMPLE 2

Using the following paper, the same copying as in Example 1 was carried out.

In a starting material comprising 100 parts of L. BKP smashed to a freeness of 440 ml was added 0.6 parts of rosin size, 2.0 parts of alum, and 15 parts of talc, which was applied to Fourdrinier machine to prepare paper whose substance was 52g/m². A sizing press solution comprising 50 parts of oxidized starch, 50 parts of clay for coating, and 500 parts of water was coated on the paper as obtained above in an amount of 6g/m² as a solid with a sizing press. A paint having the following composition was coated with an air knife coater on the both sides of the above sizing press solution coated paper in an amount of 4g/m² per one side whereby there was obtained a transferring paper having Galley air permeability of 4000 seconds, hold out (oil resistance) of 8 seconds, and curl of 5 mm.

| | |
|---|---|
| Emulsion of ammonium salt of copolymer comprising 75 mole% of ethyl acrylate, 5 mole% of butyl acrylate, and 20 mole% of methacrylic acid | 19 parts |
| Polyvinyl alcohol (Trade name:PVA 105, supplied by Kurare) | 5 parts |
| Oxidized starch | 4 parts |
| Clay for coating | 72 parts |
| Antifoaming agent (silicone) | 0.1 part |
| Sodium pyrophosphate | 0.5 parts |
| Potassium pyrophosphate | 0.5 parts |
| Water | 400 parts |

The image density was 1.2, fixability was 95%, and uniformity of image was 10.0.

EXAMPLE 3

Selenium (purity higher than 99.99%) was vapor-deposited in vacuum on an aluminum substrate in a thickness of about 60 $\mu$ to prepare a photoconductive layer. The whole surface of the photoconductive layer was uniformly charged with corona discharge of +6KV and thereafter subjected to light pattern to form electrostatic latent image thereon. The electrostatic latent image so formed was developed with the liquid developer as shown in Example 1 and there was thus obtained a clear printed image.

In a starting material comprising 100 parts of L.BKP smashed to freeness of 350 ml were added 0.3 parts of rosin size, 0.5 parts of alum, and 8 parts of talc, which was applied to Fourdrinier machine to prepare a paper whose substance was 60g/m². A sizing press solution having the following composition was coated on the thus-formed paper in an amount of 2.0g/m² as solid, and there was thus obtained a paper having Galley air permeability of 1500 seconds, hold out of 5 seconds, and curl of 8 mm.

| | |
|---|---|
| Amine salt aqueous solution of copolymer comprising 50 mole% of ethyl acrylate, 35 mole% of methyl methacrylate, 10 mole% of acrylic acid, and 5 mole% of methacrylic acid | 100 parts |
| Citric acid | 1.0 part |
| Antifoaming agent (silicone) | 0.5 parts |
| Water | 2000 parts |

The above formed image was transferred onto the transferring paper in accordance with Corona transferring process, and thereafter dried by hot air and there was thus obtained copy having transferred image density of 1.2, fixability of 75%, and smoothness of image of 9.0.

EXAMPLE 4

| | |
|---|---|
| Photoconductive zinc oxide | 100g |
| Styrene-butadiene copolymer (50% toluene solution) | 120g |
| n-butyl methacrylate (50% toluene solution) | 40g |
| Toluene | 120g |
| Rose Bengal (1% methanol solution) | 4 ml |

The above compounds were admixed in a ceramic ball mill for 6 hours to prepare a dispersion. The dispersion was coated on a 0.05 mm thick aluminum plate with a wire bar to form a 40 $\mu$ thick film, when dried, and dried with hot air to evaporate solvent and there was then obtained a zinc oxide photosensitive plate.

On the other hand, the following were admixed in a ceramic ball mill for about 20 hours to prepare a dispersion.

| | |
|---|---|
| Carbon black | 4g |
| Cyclized rubber (20% xylene solution) | 60g |
| Manganese naphthate (20% xylene solution) | 5g |
| Isopar G(Trade name) petroleum solvent | 120g |

20 ml of the dispersion thus prepared was dissolved in 2 $l$ of Isopar G while stirring to prepare a liquid developer. The above zinc oxide photosensitive plate was wholly corona-charged to −6KV and then subjected to light pattern to form electrostatic latent image thereon. The electrostatic latent image was developed with the liquid developer as prepared above and there was thus obtained visible image.

To a starting material comprised of 100 parts of L.BKP smashed to freeness of 420 ml was added 0.5 parts of rosin size, 1.0 part of alum, and 8 parts of talc. The mixture was applied to Fourdrinier machine to prepare a paper whose substance was 60g/m². A sizing press solution having the following composition, was coated on the paper in an amount of 3.5g/m² with a sizing press. Then there was obtained a paper having Galley air permeability of 1200 seconds, hold out of 5 seconds, and curl of 4 mm.

| | |
|---|---|
| 80% sodium neutralized copolymer comprising 50 mole% of butyl acrylate, 30 mole% of methyl acrylate, 5 mole% of acrylonitrile, and 15 mole% of methacrylic acid (aqueous solution) | 50 parts |
| Polyvinyl alcohol (Trade name: N-300, supplied by Nippon Gosei Kagaku) | 20 parts |
| Calcium carbonate for coating | 30 parts |
| Antifoaming agent (silicone) | 0.5 parts |
| Water | 900 parts |

The above developed image was transferred onto the paper thus prepared and dried with hot air, where by there was obtained a copy having transferred image density of 1.1, fixability of 70%, and uniformness of image of 9.0.

EXAMPLE 5

100g of a 20% solution of poly-n-vinylcarbazole in benzene was prepared, into which 2 ml of a 10% solution of Rose Bengal in ethanol was added. The mixture was fully stirred until it became homogeneous. The homogeneous solution so obtained was coated on a 0.05 mm thick aluminum plate to form a 10 $\mu$ thick dry film and dried with hot air to form a photosensitive member.

The photosensitive member so obtained was wholly charged by corona discharge of +6KV and subjected to light pattern to form an electrostatic latent image thereon. The electrostatic latent image was developed with the liquid developer as shown in Example 1 and there was thus obtained a clear printed image.

To 100 parts of L.BKP smashed to freeness of 440 ml were added 0.5 parts of rosin size, 1.0 part of alum, and 8 parts of talc. The mixture was applied to Fourdrinier machine to prepare a paper whose substance was 60g/m². The sizing solution having the following composition was coated on both sides of the above-prepared paper in an amount of 4.0g/m² (as solid) with a sizing press.

There was obtained a transferring paper having air permeability of 440 seconds, hold out of 4 seconds, and curl of 5 mm.

| | |
|---|---|
| Emulsion of copolymer comprising 50 mole% of ethyl alcohol, 20 mole% of methyl methacrylate, 25 mole% of acrylic acid, and 5 mole% of acrylonitrile | 33 parts |
| Polyvinyl alcohol | 33 parts |
| Clay for coating | 33 parts |
| Antifoaming agent | 0.5 parts |
| Water | 900 parts |

The above developed image was transferred to the transferring paper thus obtained and dried with hot air, and there was thus obtained a copy having transferred image density of 1.1, fixability of 90%, and uniformity of image of 8.5.

EXAMPLE 6

100 parts of fine crystal CdS and 20 parts of a 30% solution of vinyl chloride — vinyl acetate copolymer in toluene were mixed and the viscosity of the resulting mixture was adjusted to one suitable in coating by adding toluene thereto. The thus-prepared dispersion solution was coated on an aluminum substrate to form a 40$\mu$ thick film, when dried, and dried. Polyethylene terephthalate film (thickness of 30$\mu$) was adhered onto the photoconductive layer as obtained above by an epoxy resin based adhesive to produce a three layer photosensitive member.

Using the three layer photosensitive member, electrostatic latent image was formed according to the electrophotographic process as described in Japanese Patent Publication No. 23910/1967.

The following were admixed for about 2 hours with a mixer to prepare a dispersion solution.

| | |
|---|---|
| Carbon black | 6g |
| Cyclized rubber (20% xylene solution) | 40g |
| Low molecular polyethylene having an average molecular weight of 1000 (20% xylene solution) | 5g |
| Cumarone resin (20% xylene solution) | 30g |
| Isopar G (Trade name) petroleum solvent | 120 g |

20 ml of the above dispersion solution was dissolved in 2 $l$ of Isopar G containing 40 ml of lecitine with stirring to prepare a liquid developer. The above electrostatic latent image was developed with the liquid developer to obtain a clear image on the photosensitive member.

On a paper comprising 90 parts of broad leaved tree bleached kraft pulp (L.BKP), 10 parts of clay, 0.6 parts of resin size, and 2.0 parts of alum, whose substance was 60g/m², was coated the following paint with a sizing press. Then there was obtained a transferring paper having hold out, as measured by dropping 0.04 ml of Isopar G, of 3.0 seconds, Galley air permeability of 280 seconds, and smoothness of 120 seconds.

| | |
|---|---|
| Emulsion comprising 50 mole% of ethyl acrylate, 20 mole% of methyl methacrylate, and 30 mole% of acrylic acid | 25 parts |
| 80% sodium hydroxide neutralized aqueous solution of resin comprising 50 mole% of butyl acrylate, 30 mole% of methyl methacrylate, 5 mole% of acrylonitrile, and 15 mole% of methacrylic acid | 25 parts |
| Polyvinyl alcohol (Trade name: PVA 117, supplied by Kurashiki Rayon) | 25 parts |
| Calcium carbonate for coating | 40 parts |
| Antifoaming agent (Nopco 1407) | 0.1 part |
| (The ratios of components are shown as solid portion) | |

The above developed image was transferred to the transferring paper according to Corona transferring process and dried with hot air, and there was obtained a clear printed image whose fixability was excellent. The image density was 1.2, fixability was 90%, smoothness of image was 9.0, and curl was 5mm.

When, in this example, 30 parts of acrylic emulsion and 30 parts of polyvinyl alcohol were used excluding the water soluble acrylic resin, there occured gum up at a sizing press and a coating for a long period of time was not possible.

EXAMPLE 7

A photoconductive layer, which was prepared by vacuum depositing selenium (purity: higher than 99.99%) on an aluminum substrate in the thickness of about 60 $\mu$, was entirely charged with corona discharge of +6KV and thereafter exposed to light pattern to form electrostatic latent image thereon. The electrostatic latent image so formed was developed with a liquid developer as shown in Example 1 and there was thus a clear printed image.

On the other hand, the following paint was coated on the same paper as in Example 1 with a sizing press in an amount of 4.0g/m$^2$. Then there was obtained a transferring paper having Isopar G hold out of 2.5 seconds, and smoothness of 110 seconds.

| | |
|---|---|
| Vinyl acetate emulsion (Trade name: Kurare OM, supplied by Kuraray Co. Ltd.) | 30 parts |
| Polyvinyl alcohol (Trade name: NH-18, supplied by Nippon Gosei Kagaku) | 15 parts |
| Water soluble acrylic resin in Example 1 | 25 parts |
| Clay for coating | 30 parts |
| Calcium stearate (Trade name: Nippon Yushi Karushium Suteareito) | 0.5 parts |

The above developed image was transferred to the above transferring paper and dried by hot air and there was then obtained copy having transferred image density of 1.1, fixability of 85%, image uniformity of 9.0, and curl of 6mm.

EXAMPLE 8

| | |
|---|---|
| Photoconductive zinc oxide | 100 g |
| Styrene-butadiene copolymer (50% toluene solution) | 120 g |
| n-butyl methacrylate (50% toluene solution) | 40 g |
| Toluene | 120 g |
| Rose Bengal (1% methanol solution) | 4 ml |

The above compounds were dispersed in a ball mill for 6 hours. The dispersion was coated on a 0.05mm thick aluminum plate with a wire bar to provide a film of 40$\mu$ thickness, when dried, and dried with hot air to evaporate solvent, whereby there was obtained a zinc oxide photosensitive member.

On the other hand, the following were admixed in a porcelain ball mill for about 20 hours and 20 ml of the resulting dispersion was added with stirring into 2 $l$ of Isopar G to form a liquid developer.

| | |
|---|---|
| Carbon black | 4 g |
| Cyclized rubber (20% xylene solution) | 60 g |
| Manganese naphthanate (20% xylene solution) | 5 g |
| Isopar G (Trade name) petroleum solvent | 120 g |

The above zinc oxide photosensitive plate was entirely charged with corona discharge of −6KV and exposed to light pattern to form electrostatic latent image thereon. The electrostatic latent image was developed with a liquid developer and there was then obtained a clear printed image.

Thereafter, the following paint was coated on one side of the paper as used in Example 1 with an air knife coater in an amount of 4.0g/m$^2$ and there was obtained a transferring paper having Isopar G hold out (resistance to oil) of 6.0 seconds, Galley air permeability of 2,000 seconds, and smoothness of 200 seconds.

| | |
|---|---|
| Styrene-butadiene latex (Trade name: JSR-0660) | 20 parts |
| Polyvinyl alcohol (Trade name: kurare PVA 105) | 5 parts |
| Amine salt solution of resin comprised of 50 mole % of ethyl acrylate, 35 mole % of methyl acrylate, 10 mole % of acrylic acid, and 5 mole % of methacrylic acid | 5 parts |
| Clay for coating | 70 parts |
| Antifoaming agent (Nopco 1407) | 0.1 part |
| Melamine resin (sumirez 613, supplied by Sumitomo Kagaku) | 0.5 parts |
| Sodium pyrophosphate (PT, supplied by Taiheiyo Kagaku) | 0.4 parts |

The above developed image was transferred to the transferring paper and dried with hot air to form a copy having transferred image density of 1.1, fixability of 85%, and image uniformity of 8.5. The transferring paper was coated on one side thereof and thus curl was 13mm.

When the image was transferred to high quality paper of 64g/m$^2$ for offset printing for comparison, image density was 0.5, fixability was 95%, and image smoothness was 4.0.

EXAMPLE 9

A 20% solution of poly-n-vinyl carbazole in benzene was prepared, into which 2 ml of a 1% solution of Benzal in ethanol was added. The resulting mixture was stirred until it become homogeneous.

The homogeneous solution was coated on a 0.05mm aluminum plate to form a 10$\mu$ thick layer when dried and dried with hot air whereby there was obtained a photosensitive plate.

The photosensitive plate thus formed was entirely charged with corona discharge of +6KV and exposed to light pattern to form electrostatic latent image thereon. The latent image was developed with a developer shown in Example 1 and there was obtained a clear developed image.

Thereafter, the following coating liquid was coated on the paper as used in Example 1 with a sizing press in an amount of 4.0g/m² (as solid). There was obtained a transferring paper having Isopar G hold out (resistance to oil) of 2.5 seconds, Galley air permeability of 230 seconds, and smoothness of 115 seconds.

| | |
|---|---|
| Ethylene-vinyl acetate emulsion (OM-4000, supplied by Kurashiki Rayon) | 25 parts |
| Sodium salt aqueous solution of copolymer comprised of 50 mole % of butyl acrylate, 30 mole % of methyl methacrylate, 15 mole % of methacrylic acid, and 5 mole % of acrylonitrile | 25 parts |
| Polyvinyl alcohol (Kurashiki Rayon, PVA-105) | 25 parts |
| Clay for coating | 25 parts |
| Antifoaming agent (Nopco DF-122) | 0.1 part |
| Calcium stearate (Nippon Yushi Karushium Suteareito) | 0.5 parts |

The above developed image was transferred to the transferring paper and then dried with hot air whereby there was obtained a copy having transferred image density of 1.1, fixability of 85%, image uniformity of 9.0 and curl of 4mm.

I claim:

1. Transfer paper for electrophotography adapted to receive a developed image by liquid developer comprising a cellulosic web containing a copolymer formed from about 55 – 95 mole percent of one or more monomers represented by the formula:

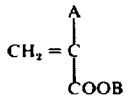

wherein A is hydrogen or $CH_3$; and B is alkyl, and from about 5 to 35 mole percent of one or more monomers of unsaturated carboxylic acids, and from about 0 to 10 mole percent of acrylonitrile.

2. Transfer paper according to claim 1 in which B is alkyl having not more than 10 carbon atoms.

3. Transfer paper according to claim 1 in which the glass transition temperature of the copolymer ranges from 20° to 50°C.

4. Transfer paper according to claim 1 in which the resistance to oil of the transfer paper is 1.0 – 10.0 sec.

5. Transfer paper according to claim 1 in which the unsaturated carboxylic acid is selected from acrylic acid, methacrylic acid, itaconic acid and maleic anhydride.

6. Transfer paper according to claim 1 in which the copolymer is neutralized or partly neutralized.

7. Transfer paper according to claim 1 including a water-soluble high polymer of good compatibility with and different from said copolymer.

8. Transfer paper according to claim 1 including an emulsion of a resin different from said copolymer.

9. Transfer paper according to claim 2 in which B is selected from methyl, ethyl, butyl, hexyl, octyl and 2-ethylhexyl.

10. Transfer paper according to claim 6 in which a neutralizing agent for the neutralization is sodium hydroxide, ammonia or an organic amine.

11. Transfer paper according to claim 7 in which the water-soluble high polymer is selected from polyvinyl alcohol, carboxy-methylcellulose, methylcellulose, ethylcellulose, starch, starch derivatives, casein, styrene-maleic anhydride copolymer salts, and vinyl acetate-maleic anhydride salts.

12. Transfer paper according to claim 8 in which the resin emulsion is selected from vinyl acetate series emulsion, acryl series emulsion, acrylonitrile-butadiene series emulsion, ethylene-vinyl acetate series emulsion, and vinylidene chloride series emulsion.

* * * * *